United States Patent [19]

Pinson

[11] Patent Number: 5,016,537

[45] Date of Patent: May 21, 1991

[54] CONTROLLED EXPLOSIVE, HYPERVELOCITY SELF-CONTAINED ROUND FOR A LARGE CALIBER GUN

[75] Inventor: George T. Pinson, Huntsville, Ala.

[73] Assignee: The Boeing Company, Seattle, Wash.

[21] Appl. No.: 490,378

[22] Filed: Mar. 8, 1990

[51] Int. Cl.[5] ..... F42B 5/16

[52] U.S. Cl. ..... 102/443; 89/8; 102/472

[58] Field of Search ..... 102/430, 443, 472; 89/8

[56] References Cited

U.S. PATENT DOCUMENTS

| | | | |
|---|---|---|---|
| 241,978 | 5/1881 | Haskell . | |
| 372,678 | 11/1887 | Hurst | 102/443 |
| 484,009 | 10/1892 | Haskell . | |
| 2,360,217 | 10/1944 | Francis . | |
| 3,031,933 | 5/1962 | Kern et al. . | |
| 3,388,633 | 6/1968 | Kirshner | 102/443 |
| 3,411,403 | 11/1968 | Rodenberger . | |
| 3,418,878 | 12/1968 | Stricklin . | |
| 3,459,101 | 8/1969 | Scanlon . | |
| 4,712,465 | 12/1987 | Macdonald . | |
| 4,930,421 | 6/1990 | Macdonald . | |

*Primary Examiner*—Harold J. Tudor

*Attorney, Agent, or Firm*—Finnegan, Henderson, Farabow, Garrett & Dunner

[57] ABSTRACT

A round for placement and firing in the barrel of a large caliber gun, the round comprising a cartridge case defining a cylindrical chamber having axially opposed open and closed ends, a plurality of axially-adjacent annualr explosive charges coaxially-disposed in the chamber, the charges defining a bore coaxial with said chamber and each charge being shaped to generate on detonation a predetermined shock wave in the case, a projectile disposed in the chamber proximate the closed end, the projectile having a trailing end shaped to convert shock waves generated by detonation of the annular charges to projectile acceleration, an explosive in the case for initially propelling the projectile axially through the bore toward the open, end, an electrical detonator for each annular charge responsive to an electrical signal, and a power source and circuit for generating the electrical signal in response to axial movement of the projectile in the bore.

13 Claims, 5 Drawing Sheets

CONTROLLED EXPLOSIVE, HYPERVELOCITY SELF-CONTAINED ROUND FOR A LARGE CALIBER GUN

BACKGROUND OF THE INVENTION

1. Field of the Invention

The invention relates to a self-contained round for a large caliber artillery or anti-tank weapon and in particular a round including electrically-detonated secondary explosives for accelerating a projectile to hypervelocity speeds.

2. Description of Related Art

Current large caliber projectiles travel at relatively low speeds. In most cases, the speeds are slightly subsonic (approximately 900 ft./sec.). These speeds may be augmented for high penetration devices (approximately 3,000 ft./sec.). These relatively low speed projectiles require flight time for one kilometer (neglecting drag) of approximately 3.6 seconds. This long flight time requires consideration of the effects of target motion, wind, gravity, and other trajectory perturbations. For example, a target moving 15 meters per second moves 54 feet during a 3.6 second flight time. This lead must be included in the aim of a weapon.

One method developed for terminal kills that uses a high speed projectile is based on the self-forging fragmentation warhead. In this design, the warhead is triggered and melts the liner. Molten droplets of the liner are accelerated to speeds of between 8,000 to 12,000 ft./sec. The metal fragments strike the target causing damage. Such warheads, however, are range limited to approximately 200 ft., due in part to the irregular shape of the warhead fragments which are not aerodynamically efficient. High drag acting on the irregular fragments cause them to lose speed rapidly.

The concept of using secondary explosives in weapons to accelerate projectiles has long been known. U.S. Pat. No. 241,978, which issued in 1881, is directed to a gun incorporating secondary explosives disposed to act on the projectile during its travel through the barrel of the gun. The patented device required a complex construction of a gun barrel to permit location of powder charges which are selectively detonated, the gas from which adds acceleration to the projectile. Other similar concepts are shown in U.S. Pat. Nos. 484,009, 2,360,217, and 3,459,101.

Other apparatus for accelerating projectiles are taught in U.S. Pat. Nos. 3,411,403 and 3,418,878. In these patents, a moving projectile is introduced into a disposable explosive lined barrel. The friction from the projectile passing through the barrel ignites the explosive generating gas to further accelerate the projectile. The patents do not suggest how the concept would be used in a weapon in view of the disposable nature of the barrel and the need for another device to accelerate the projectile prior to entry into the barrel.

Finally, U.S. Pat. No. 3,031,933 teaches an explosive linear accelerator including a plurality of axially-adjacent, coaxial, annular explosive charges supported on a rack structure and defining a bore for passage of a projectile. The device includes a complex electrical system for detonating in succession the annular explosive charges in response to passage of the projectile through the bore. No consideration is given for use of the device as a weapon.

The subject invention is directed to a self-contained round for use large caliber artillery or anti-tank weapon. The round includes a projectile a primary charge, secondary charges, and means for selectively activating the secondary charges in order to accelerate the projectile within the cartridge case of the round. The round of the invention, in one embodiment, may be used in existing large caliber weapons. This is distinct from the prior efforts discussed above in which the secondary acceleration mechanism is incorporated into the gun rather than the cartridge or in which the entire concept is of the laboratory type not amenable to use in a self-contained cartridge.

Additional advantages of the invention are set forth in part in the description which follows, and in part will be obvious from the description, or may be learned by practice of the invention.

SUMMARY OF THE INVENTION

The objects and advantages of the invention may be realized and obtained by means of the instrumentalities and combinations particularly pointed out in the appended claims.

In accordance with the invention, as broadly described and claimed herein, a round for placement and firing in the barrel of a large caliber gun comprises a cartridge case defining a cylindrical chamber having axially opposed open and closed ends, a plurality of axially-adjacent annular explosive charges coaxially disposed in the chamber, the charges defining a bore coaxial with the chamber and each charge being shaped to generate on detonation a predetermined shock wave in the case, a projectile disposed in the chamber proximate to closed end, the projectile having a trailing end shaped to convert shock waves generated by detonation of the annular charges to projectile acceleration, means in the case for initially propelling the projectile axially through the bore toward the open end, means for separately electrically detonating each annular charge in response to an electrical signal, and means associated with each annular charge for generating the electrical signal in response to axial movement of the projectile in the bore.

In a preferred embodiment, the means for generating an electrical signal comprises a piezoelectric ignitor electrically connected to detonators associated with each annular charge, the ignitor being disposed for compressive activation by the projectile during its axial passage through the bore defined by the annular charges.

In another embodiment, the round includes an electrical power source, a detonator associated with each annular charge, a normally open electrical circuit connecting in parallel each detonator to the power source and including a contact projecting into the bore at predetermined positions, a sabot supporting a projectile for axial movement through the bore, and means on the sabot for completing the electrical circuit as the projectile axially moves through the bore.

BRIEF DESCRIPTION OF THE DRAWINGS

The accompanying drawings which are incorporated in and constitute a part of the specification, illustrate embodiments of the invention, and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

The invention, as embodied and broadly described herein, is a round for placement and firing in the barrel of a large caliber gun, the round comprising a cartridge case defining a cylindrical chamber having axially opposed open and closed ends, a plurality of axially-adjacent annular explosive charges coaxially disposed in the chamber, the charges defining a bore coaxial with the chamber and each charge being shaped to generate on detonation a predetermined shock wave in the case, and a projectile disposed in the chamber proximate the closed end, the projectile having a trailing end shaped to convert shock waves generated by detonation of the annular charges to projectile acceleration.

Figure 1:
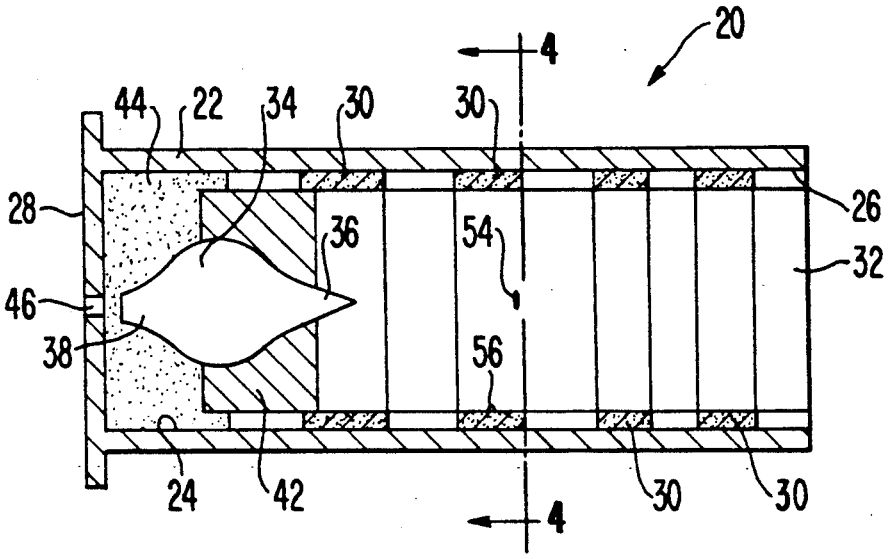
FIG. 1 is a cross-sectional side view of an embodiment of the invention.

In the embodiment depicted in FIG. 1, round 20 includes cartridge case 22 defining a cylindrical chamber 24 having axially opposed open 26 and closed 28 ends. Cartridge case 22 may be made of brass or other common substitutes such as mild steel or be made of a consumable material as is currently commonly used in military rounds. In external appearance it would not appear to be substantially different from a standard military round. Although in some embodiments the gun from which the round is fired may be specially designed for use with the invention, in other embodiments, the round would be usable in existing standard military guns and would be sized and shaped too permit loading and firing from such standard weapons.

Also as depicted in FIG. 1, the round includes a plurality of annular explosive charges 30 coaxially disposed in axial succession in chamber 24, the charges 30 defining a bore 32 coaxial with chamber 24. FIG. 1 depicts charges 30 in axially spaced relation to each other. Charges 30 may be disposed axially adjacent to each other, separated only by a separator of sufficient structural integrity to preclude the detonation of one annular charge from sympathetically detonating the next axially adjacent charge or from structurally destroying the adjacent charge. The spacing of annular charges and their axial length will depend upon their axial position and the projected speed of the projectile at the time of detonation of each such charge.

This entire firing process is dynamic in nature. For a particular application, the dimensions and explosive characteristics of each annular charge 30 must be designed with recognition that the projectile is moving through the zone influenced by the charge explosive. Since the weapon is dynamic, each annular charge 30 may have a different shape to generate a different shock wave depending upon the velocity of the projectile at the time of detonation and the shape of the trailing end of the projectile.

Figure 2:
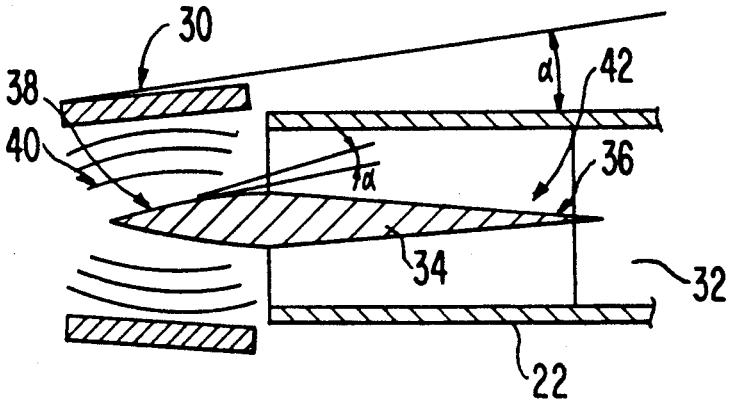
FIG. 2 is a paragrammatic side view of an embodiment of the invention depicting the effect of shaped explosives

As seen in FIG. 1, projectile 34 has a leading end 36 shaped for aerodynamic efficiency and/or armor penetration, and a trailing end 38 shaped to interact with shock waves generated on successive detonation of annular charges 30 to convert such shock waves into acceleration of projectile 34. As depicted in FIG. 2, each shaped annular charge 30 may be tilted at an angle $\alpha$ relative to the center line of bore 32. The angle $\alpha$ may correspond to the relationship between the shock wave 40 at impingement on trailing end 38 of projectile 34. This orientation of shock wave 40 with respect to trailing end 38 of projectile 34 serves to squeeze projectile 34 forward through bore 32 progressively accelerating the projectile with maximum extraction of energy from shock wave 40.

Figure 3A:
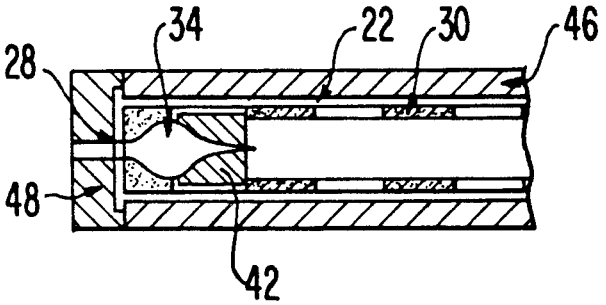
FIGS. 3*a*, 3*b* and 3*c* are cross-sectional of side views of the embodiment in FIG. 1 depicting operation of the invention in a gun barrel.
Figure 3B:
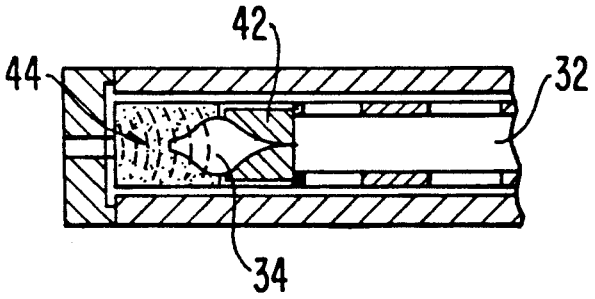
Figure 3C:
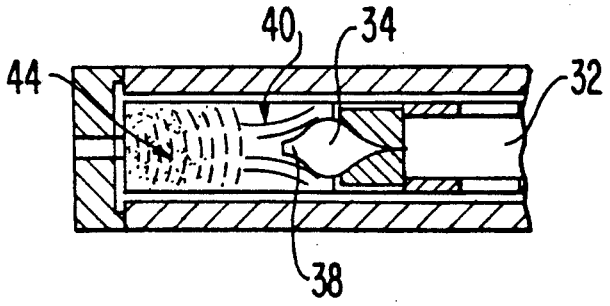

In one embodiment, as depicted in FIGS. 3*a*–3*c*, projectile 34 is supported for axial movement through bore 32 by sabot 42. Sabot 42 carries projectile 34 through bore 32 and falls away from projectile 34 on exiting the end of the gun barrel. Sabot 42 is preferably fixed to projectile 34 in a manner so as to not obstruct interaction of shock wave 40 with trailing end 38 of projectile 34 during axial acceleration through bore 32.

In accordance with the invention, the round includes means in the chamber for selectively initially propelling the projectile axially through the bore toward the open end. As embodied here and depicted in FIG. 1, the propelling means includes charge 44 disposed in chamber 24 between trailing end 38 of projectile 34 and closed end 28 of casing 22. The charge may be any common booster charge used to launch projectiles from cartridge cases. The cartridge case may also include a primer 46 disposed for mechanical or electrical ignition to activate charge 44. The charge 44 when detonated acts on trailing end 38 of projectile 34 and may act on sabot 42 to initially propel projectile 34 axially along bore 32.

As depicted in FIGS. 3*a*, 3*b* and 3*c*, projectile 34 in sabot 42 is disposed proximate closed end 28 of casing 22. The round is placed in barrel 46 of a gun with closed end 26 held in place by breach block 48. On selective ignition of explosive 44 projectile 34 and sabot 42 are initially propelled axially along bore 42. On detonation of first annular charge 30, shock wave 40 is generated and acts against trailing end 38 of projectile 34 to further accelerate projectile 34 axially along bore 32.

In accordance with the invention, the round includes means responsive to axial movement of the projectile in the bore for electrical detonating each annular charge in axial succession. Preferably this means includes means for separately electrically detonating each annular charge in response to an electrical signal and means associated with each annular charge for generating the electrical signal in response for axial movement for the projectile on the bore.

Figure 4:
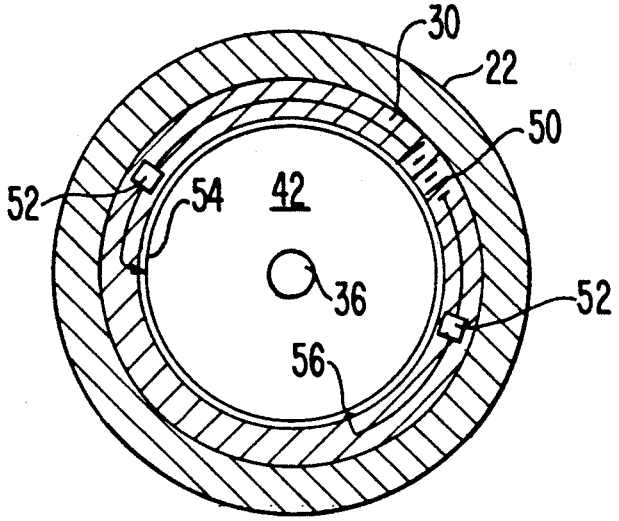
FIG. 4 is a cross-sectional view of the embodiment of FIG. 1 taken along lines IV—IV.
Figure 6A:
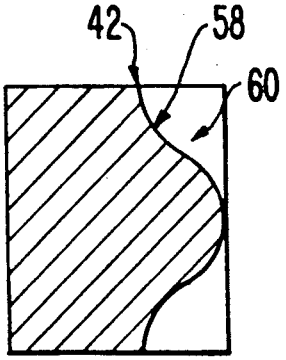
FIG. 6*a* is a flattened side view of a sabot for use with the invention.
Figure 6B:
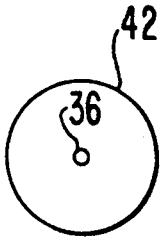
FIG. 6*b* is an end view of a sabot for use with the invention.
Figure 6C:
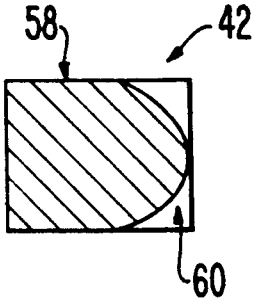
FIG. 6*c* is a side view of the sabot of FIG. 6*b*.

In one embodiment, each annular charge 30 includes a self-contained means for electrically detonating the charge in response to axial movement of the projectile. As depicted in FIG. 4, in this embodiment, each annular charge 30 includes a battery 50 electrically connected in series with a pair of detonators 52 in a open circuit terminating in contacts 54, 56. In this embodiment sabot 42 includes means for completing the circuit by electrically interconnecting contacts 54 and 56. As depicted in FIG. 1, contacts 54, 56 are axially displaced relative to one another as well as being radially placed. As seen in FIG. 6*a* and 6*c*, the surface of sabot 42 includes a shaped conductive area 58 with the remainder of sabot 42 being an insulator 60. Use of such a conductive pattern on sabot 42 permits selective cooperation with spaced contacts 54,56 such that annular charges 30 are set off at different positions relative to trailing end 38 of projectile 34. By selection of the positions of contacts 54,56 and the shape of conducting pattern 58, the relative time for detonation for each annular charge 30 may be varied to reflect the different axial velocities of projectile 34 during passage through bore 32.

Figure 5:
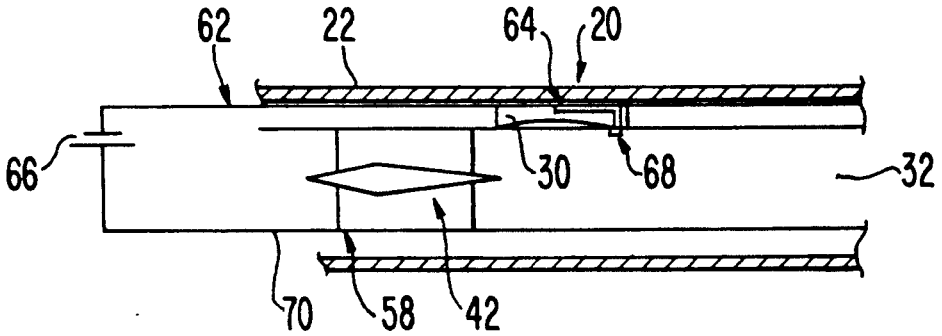
FIG. 5 is a diagrammatic side view of an alternative electrical system for use with the invention.

An alternative embodiment depicted in FIG. 5 includes an electrical wiring harness 62 electrically interconnecting detonators 64 of annular charges 30 in parallel in an otherwise normally open circuit. The circuit includes a power source 66 which may be a part of round 20 or may be incorporated into the gun used to fire round 20. In the latter instance, each round 20 includes a contact point for electrical connection to the power source incorporated into the gun. In this embodiment, contact 68 for each annular charge 30 is included in wiring circuit 62. As sabot 42 moves axially through bore 32, conductive pattern 58 completes an electric circuit between contact 68 and the other end 70 of electric circuit 62 which is radially spaced from contact 68 to detonate annular charge 30.

Figure 7:
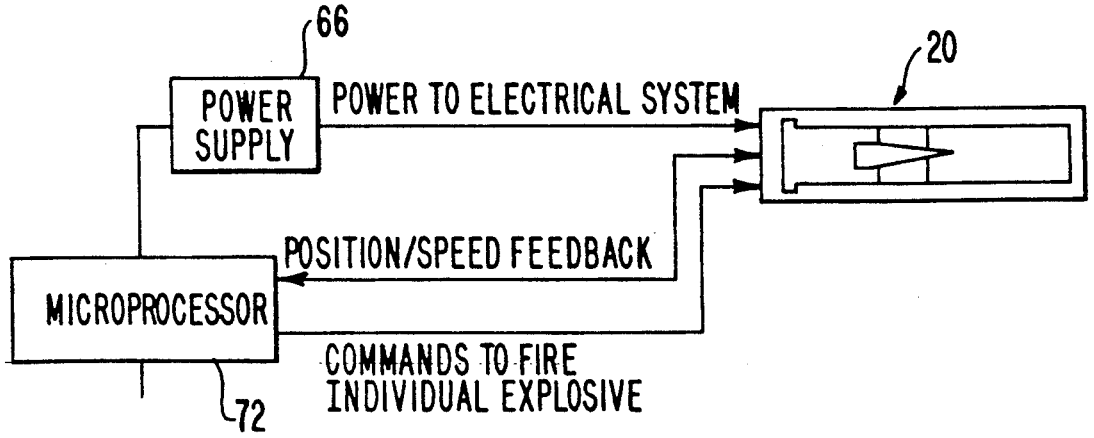
FIG. 7 is a diagrammatical representation of a control system for use with the invention.

Alternatively, in the embodiment just described, a microprocessor control system, as depicted in FIG. 7, may be used to optimize detonation of annular charges 30 to maximize acceleration of projectile 34 in cartridge case 22. In this embodiment, an external power supply 66 is included in a circuit including microprocessor 72 connected to appropriate circuitry to wiring circuit 62 in casing 22. Instead of completing the circuit on contact with contact 68 as depicted in FIG. 5, electrical connection with contact 68 is fed back to microprocessor 72 indicating the axial position of projectile 34. Microprocessor 72 then compares the axial position of projectile 34 with that required to achieve the desired terminal velocity and microprocessor 72 detonates annular charge 30. The detonation of annular charges 30 by microprocessor 72 may be varied in time in accordance with an algorithm designed to optimize acceleration of the projectile.

Since desired projectile speed is obtained while the projectile is inside the cartridge case 22, the length of the gun barrel may be greatly reduced. The gun barrel extending beyond the length of cartridge case 22 would only be required if spin stabilization of the projectile is desired. In this event, sabot 42 would include structure necessary to cooperate with barrel rifling to impose a spin stabilization on the projectile.

In an alternative and preferred embodiment depicted in FIG. 8–13, round 120 includes cartridge case 122 defining a chamber 124 having an open end 126 and a closed end 128. An inner cylindrical shell 131 is coaxially disposed in chamber 12 of casing 122.

Figure 10:
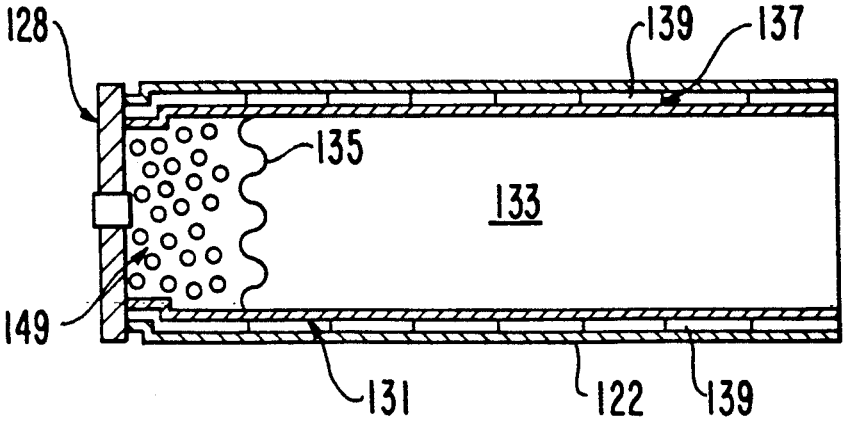
FIG. 10 is a cross-sectional side view of the cartridge case for the round depicted in FIG. 8.
Figure 11A:
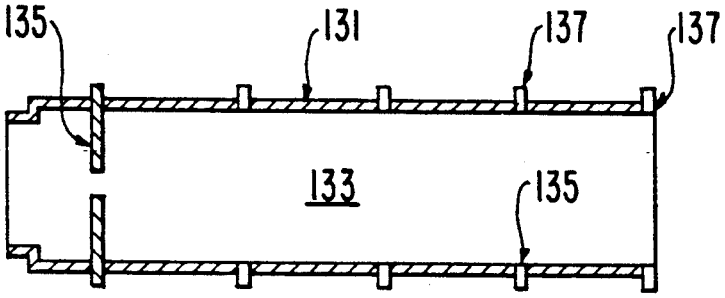
FIG. 11*a* is a cross-sectional side view of the inner-cylindrical shell of the embodiment depicted in FIG. 8.
Figure 11B:
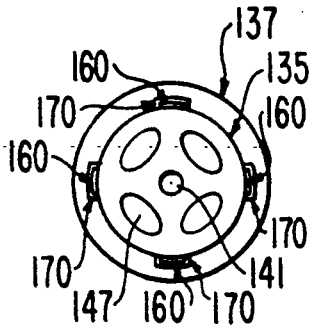
FIG. 11*b* is an end view of the shell depicted in FIG. 11*a*.

The shell, as depicted in FIGS. 11*a* and 11*b*, defines internal bore 133 coaxial with chamber 124 and includes a positioner element 135 and a plurality of axially-spaced, annular standoffs 137 disposed to cooperate with the wall of casing 122 to define a plurality adjacent annular cavities 139. Positioner element 135 is fixed to shell 131 proximate closed end 128 and includes a central bore 141 for receiving and locating trailing end 143 of projectile 145 when disposed in casing 122. The positioner element also includes openings 147 for passage of explosive gases generated on detonation of explosive 149 disposed between positioner element 135 and closed end 128 of casing 122. In lieu of positioner element 135, a frangible separator 151 as depicted in FIG. 10 may be used to hold explosive 149 at closed end 128 of casing 122 prior to firing.

Figure 8:
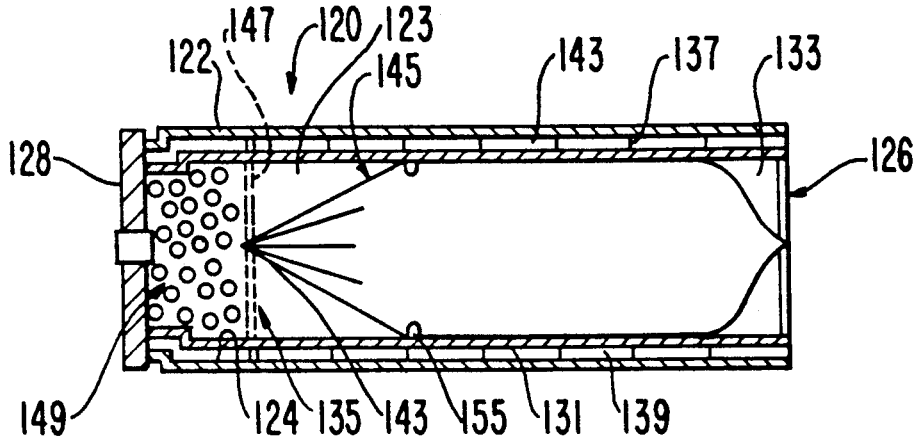
FIG. 8 is a cross-sectional side view of an embodiment of the invention.
Figure 9:
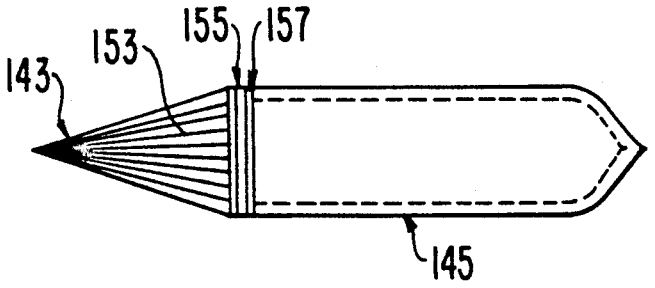
FIG. 9 is a side view of the projectile of the round depicted in FIG. 8.

As depicted in FIGS. 8 and 9, round 120 includes projectile 145 having a trailing end 143 shaped to convert annular shock waves into acceleration and preferably including flutes 15 disposed to convert pressure from explosive gases into rotation of projectile 145 about it axis. Such rotation may induce spin stabilization to the projectile precluding the need for rifling of the gun barrel.

Projectile 145 preferably includes an O-ring seal 155 and obturator 157 fixed to projectile 145 to sealing engage shell 131 preventing gaseous blow-by on explosive detonation. O-ring 155 and obturator 157 preferably extend radially from the surface of projectile 145 not only to form a seal but also, as explained below, to activate annular secondary explosives for projectile acceleration.

At least some of the annular cavities 139 contain annular, shaped explosive charges. As discussed above with respect to other embodiments, such annular explosive charges may be axially spaced or may be axially adjacent and separated by standoffs 137.

As in the other embodiments, the means for detonating each annular charge is one or more detonators associated with each charge and responsive to an electrical signal. In this embodiment, the means for generating the electrical signal is a piezoelectric igniter 160 associated with each annular charge, electrically connected to each detonator for that charge and disposed for compressive contact by projectile 145 during axial movement thereof.

Figure 12:
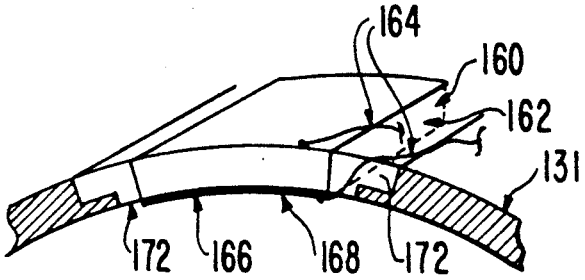
FIG. 12 is a enlarged perspective view of the portion of the embodiment in FIG. 8 depicting the piezoelectric ignitor.
Figure 13:
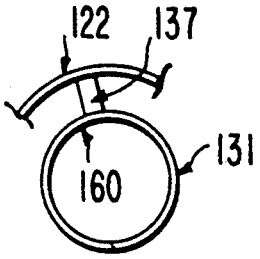
FIG. 13 is a partial end view of the device in FIG. 8.

As depicted in FIGS. 11*b*, 12 and 13, piezoelectric igniter 160 includes piezoelectric element 162, electrical leads 164 connecting element 162 to an associated detonator, and a hammer 166 protecting the inner surface of element 162 and projecting into bore 133 for compressive contact by projectile 145. Preferably, compressive contact is made by O-ring 155 and/or obturator 157 on projectile 145. A metal coating 168 may be applied to hammer 166 to protect igniter 160 from abrasion by projectile 145.

Igniter 160 preferably is disposed in cavities 170 in shell 131, separated therefrom by insulation 172. As depicted in FIG. 13, cavities 170 containing igniters 160 are preferably located radially adjacent standoffs 137 which serve as an anvil against which element 162 is compressed by projectile 145. As depicted in FIG. 11B, each annular charge may have associated therewith one or more circumferentially-spaced igniters 160.

In operation, detonation of explosive 149 at closed end 128 of casing 122 begins axial movement of projectile 145. Selectively placed igniters 160 in the first annular charge are compressed by O-ring 155 generating an electrical potential sufficient to activate a detonator associated with the first charge. Detonation of the first charge generates a shock wave designed to impinge on trailing end 143 of projectile 145 to accelerate the projectile. The gases from the first annular charge may also act on flutes 153 to further spin projectile 145 in the same direction as initiated by explosive 149. Each annular charge is detonated in the same manner in response to axial movement of projectile 145.

It will be apparent to those skilled in the art that various modifications and variations could be made to the round of the invention without departing from the scope or spirit of the invention.

What is claimed is:

1. A round for selective removable placement in and firing from a large caliber gun comprising:

a cartridge case defining a cylindrical chamber having axially opposed open and closed ends;

a plurality of annular explosive charges disposed in said chamber in axial succession from a first charge spaced from said closed end to a last charge proximate said open end, said annular charges defining a bore coaxial with said chamber and each said annular charge being shaped to generate on detonation a predetermined shock wave;

a projectile having leading and trailing ends and being disposed in chamber proximate said closed end, the trailing end of said projectile being shaped to convert to projectile acceleration the shock waves generated on successive detonation of said annular charges;

means in said chamber for selectively initially propelling said projectile axially through said bore toward said open end; and means responsive to axial movement of said projectile in said bore for electrically detonating each said annular charge in axial succession from said first to said last.

2. The round of claim 1 also including a sabot supporting said projectile for axial movement through said bore.

3. The round of claim 2 wherein said detonating means comprises an electrical detonator associated with each said annular charge, an electrical power source, a normally open electrical circuit connecting each said detonator in parallel to said power source, a contact in said electrical circuit for each said annular charge projecting into said bore at a predetermined position, and means on said sabot for successively engaging each said contact during axial movement of said projectile to electrically close said circuit and to electrically detonate each annular charge in succession.

4. The round of claim 2 wherein said detonating means comprises an electrical detonator associated with each said annular charge and a piezoelectric igniter electrically connected to each detonator and disposed for compressive contact by said sabot to successively electrically detonate said annular charges during axial movement of said projectile.

5. The round of claim 2 wherein said detonating means comprises for each said annular charge an open electrical circuit including a battery, an electrical detonator, and first and second axially-spaced contacts projecting into said bore at predetermined positions, and conducting means on said sabot for electrically connecting said first and second contacts during axial movement of said projectile to electrically detonate each said annular charge in succession.

6. The round of claim 1 wherein said annular charges are axially spaced a predetermined distance.

7. The round of claim 1 including means axially separating said annular charges for preventing premature sympathetic detonation of or destruction of successive annular charges by detonation of a preceding annular charge.

8. The round of claim 1 wherein the trailing end of said projectile also includes means for converting explosive gases into rotation of said projectile about its axis.

9. A round for placement and firing in the barrel of a large caliber gun, said round comprising:

a cartridge case defining a cylindrical chamber having axially opposed open and closed ends;

a plurality of axially-adjacent annular explosive charges coaxially-disposed in said chamber, said charges defining a bore coaxial with said chamber and each said charge being shaped to generate on detonation a predetermined shock wave in said case;

a projectile disposed in said chamber proximate said closed end, said projectile having a trailing end shaped to convert shock waves generated by detonation of said annular charges to projectile acceleration;

means in said case for initially propelling said projectile axially through said bore toward said open end;

means for separately electrically detonating each said annular charge in response to an electrical signal; and means associated with each said annular charge for generating said electrical signal in response to axial movement of said projectile in said bore.

10. The round of claim 9 wherein said detonating means includes an electrically-activated detonator operatively disposed in conjunction with each said annular charge.

11. The round of claim 10 wherein said generating means comprises a piezoelectric igniter electrically connected to each said detonator and disposed for compressive activation by said projectile during axial passage thereof through said bore.

12. A round for placement and firing in the barrel of a large caliber gun, said round comprising:

a cartridge case defining a cylindrical chamber having axially opposed open and closed ends;

an inner cylindrical shell coaxially disposed in said casing, said shell defining an inner bore and including means for defining a plurality of axially-adjacent, annular cavities between said shell and said case;

an annular explosive charge disposed in each of a plurality of said annular cavities, each said charge being shaped to generate on detonation a predetermined shock wave in said case;

a projectile disposed in said bore, said projectile having a trailing end shaped to convert shock waves generated by detonation of said annular charges to projectile acceleration;

means for initially propelling said projectile axially through said bore toward said open end;

an electrical detonator in each said annular charge; and a piezoelectric igniter electrically connected to each said detonator and disposed for compressive activation by said projectile during axial passage thereof through said bore.

13. The round of claim 1 wherein said defining means comprises a plurality of axially-spaced, annular spacers disposed between said case and said shell and wherein said igniters are disposed to be compressed against said spacers during axial passage of said projectile.

* * * * *